US006474197B1

(12) United States Patent
Browen et al.

(10) Patent No.: US 6,474,197 B1
(45) Date of Patent: Nov. 5, 2002

(54) CUTOUT FUSE TUBE INSTALLATION TOOL

(75) Inventors: Troy Browen, Brooklyn Park, MN (US); Lewis A. Shaw, Hastings, MI (US); Mark Kaiser, Hastings, MI (US)

(73) Assignee: Hastings Fiber Glass Products, Inc., Hastings, MI (US)

( * ) Notice: Subject to any disclaimer, the term of this patent is extended or adjusted under 35 U.S.C. 154(b) by 0 days.

(21) Appl. No.: 10/041,300

(22) Filed: Jan. 8, 2002

Related U.S. Application Data

(60) Provisional application No. 60/316,809, filed on Aug. 31, 2001.

(51) Int. Cl.[7] ..... B67B 7/00

(52) U.S. Cl. ..... 81/3.8; 294/19.1; 81/53.1

(58) Field of Search ..... 81/3.8, 418, 53.1; 294/116, 19.1, 86.4

(56) References Cited

U.S. PATENT DOCUMENTS 1,853,598 A * 4/1932 Birkenmaier ..... 81/3.8
1,858,133 A * 5/1932 Bodendieck ..... 294/116
2,816,985 A * 12/1957 Lindell ..... 218/12
3,026,391 A * 3/1962 Bridges et al. ..... 254/120
5,532,668 A 7/1996 Fennell
5,593,196 A 1/1997 Baum et al.
5,670,927 A 9/1997 Fennell
5,861,595 A * 1/1999 Wood et al. ..... 200/17 R

OTHER PUBLICATIONS

Flyer Printout of Cutout Fuse GRAB—IT™ from Utility Solutions web page; at least as early as August, 2001; 1 page.

* cited by examiner

*Primary Examiner*—James G. Smith
*Assistant Examiner*—Hadi Shakeri
(74) *Attorney, Agent, or Firm*—Flynn, Thiel, Boutell & Tanis, P.C.

(57) ABSTRACT

A cutout fuse tube assembly installation tool includes a body member having first and second ends. A longitudinal axis passes through the body member. A protrusion extends outward from the first end of the body member and includes a head end spaced apart from the body member. The second end of the body member includes a bracket that has first and second arms spaced apart by an opening. A bracket axis passes through the opening. The bracket, the bracket axis and the protrusion are configured such that the bracket axis passes between the head end of the protrusion and the body member. A movable gate device is mounted on one or both of the first and second arms. The gate device facilitates opening and closing of an access to the opening through the ends of the first and second arms.

9 Claims, 9 Drawing Sheets

CUTOUT FUSE TUBE INSTALLATION TOOL

This application claims the benefit of Provisional application Ser. No. 60/316,809, filed Aug. 31, 2001.

FIELD OF THE INVENTION

This invention relates generally to a tool for installing cutout fuse tubes and, more particularly, to a tool for installing cutout fuse tubes that secures the fuse tube during the duration of the installation process.

BACKGROUND OF THE INVENTION

Cutout fuse tubes are typically positioned in electric circuits. These devices, which are suspended from power lines by an upper support member and a lower support member of a cutout, include a fuse link that allows current to flow through the cutout. When currents of normal levels are flowing through the electric circuit, the fuse link will be unaffected. However, when a fault or an over-current occurs in the circuit, the fuse link will react, causing an interruption of the current in the circuit. As a result of the reaction of the fuse link, the "blown" cutout fuse tube will be disengaged from the upper support member and will rotate downward into a "drop down" position.

A number of devices have been developed to remove these old or "blown" fuse tubes and to install new fuse tubes. Typically, a utility worker uses a hook shaped tool attached to a hot stick, or other suitable device, to engage the trunnion of the old fuse tube. Once the trunnion is engaged, the hot stick is maneuvered to allow the old fuse tube to be lifted from the lower support member. The utility worker then removes the old fuse tube from the hot stick, such as by lowering it to the ground. A trunnion of the replacement fuse tube is then slid over the hook on the hot stick, and the hot stick is maneuvered to position the lower end of the new fuse tube on the lower support member. The fuse tube is then rotated upward until the upper end is secured into the upper support member. However, since the fuse tube is attached to the hot stick only by the hook, it can easily be disengaged from the hot stick. The fuse tube can then become disengaged from the lower support member and drop to the ground, or even strike the utility worker. In addition, as a result of the structure of the prior art tool, once the old fuse tube is removed, the hot stick must be lowered so the replacement fuse tube can be attached, thus increasing the time needed to perform the task.

SUMMARY OF THE INVENTION

The objects and purposes of the invention are met by providing a fuse tube installation tool that includes a body member having a longitudinal axis and including a first end and a second end. A fastener extends from the first end of the body member and has a head end that is spaced apart from the body member. The second end of the body member includes a bracket that has a first arm that is spaced apart from a second arm by an opening. The first and second arms are connected to one another at one end thereof and free of connection to one another at the other end thereof. The bracket has a bracket axis that passes through a center of the opening. The bracket and the bracket axis are oriented with respect to the fastener such that a plane containing the bracket axis passes between the head end of the fastener and the body member. A movable gate device is provided on one of the first and second arms to facilitate opening and closing an access to the opening through the other end.

BRIEF DESCRIPTION OF THE DRAWINGS

The above and further features and benefits of this invention will be understood by reference to the following detailed description, as well as by reference to the following drawings in which.

DETAILED DESCRIPTION

Figure 1:
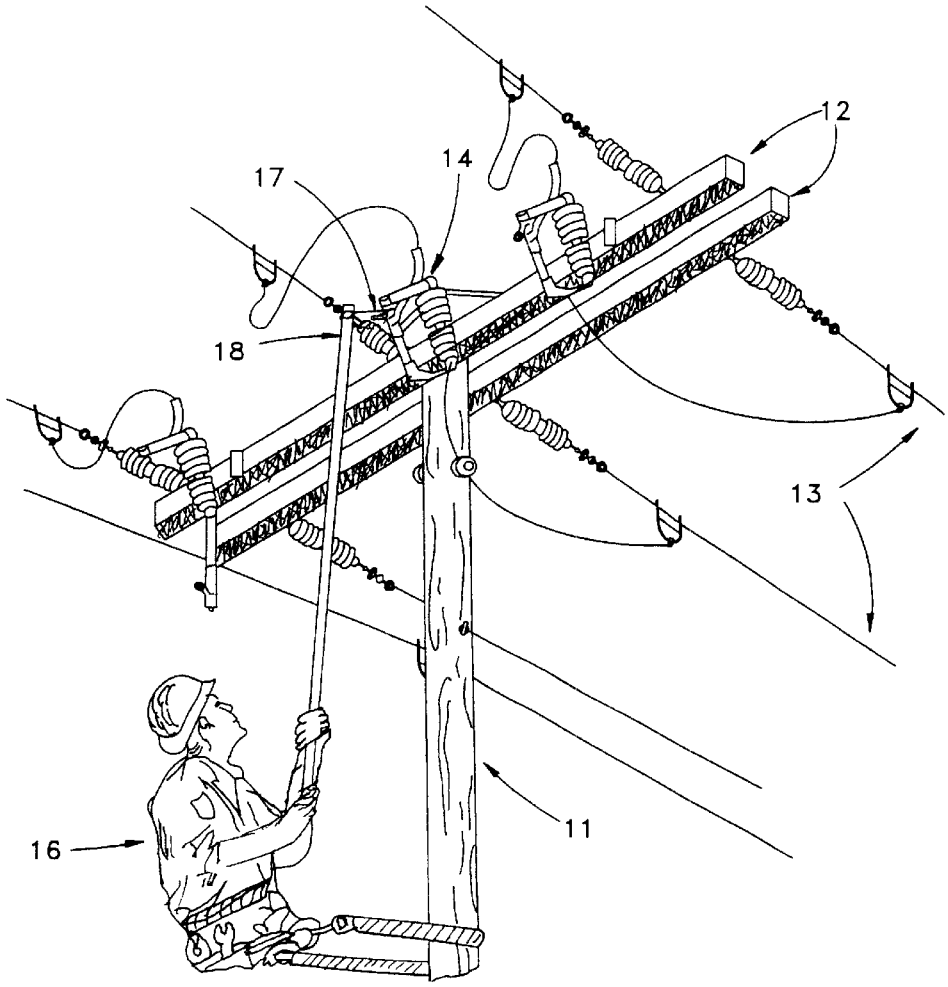
FIG. 1 (PRIOR ART)
FIG. 1 is an isometric view of a utility worker replacing a cutout fuse tube utilizing a prior art cutout fuse tube installation tool.

Referring to FIG. 1 there is illustrated a utility pole 11 including two cross arms 12. Extending from the cross arms 12 are a plurality of power lines 13. Suspended from cross arms 12, and connected to each of the power lines 13 is one of the cutouts 14. A utility worker 16 is illustrated completing installation of one cutout fuse tube with a prior art installation tool 17. The utility worker 16 has been illustrated suspended from a top portion of the utility pole 11, such as by a conventional pole climbing device. The utility worker 16 is utilizing a conventional hot stick 18 to replace the cutout fuse tube.

Figure 2:
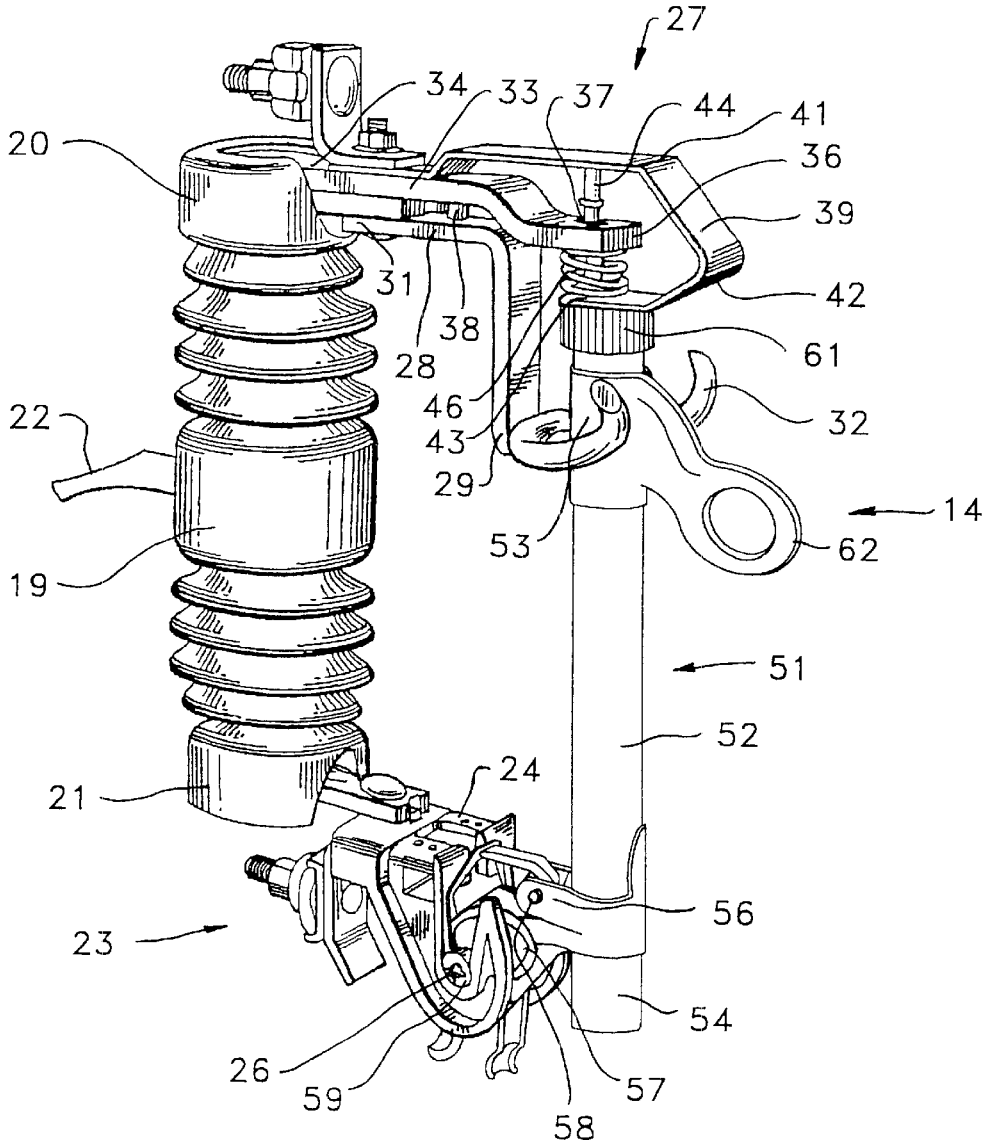
FIG. 2 (PRIOR ART)
FIG. 2 is an isometric view of one of the cutouts of FIG. 1.

Referring to FIG. 2, the cutout 14 has been illustrated. However, since this is a conventional component that is well known in the art, only a brief description of this device will be provided. The cutout 14 includes an elongated insulator 19 having an upper end 20 and a lower end 21. Attached to the insulator 19 is a mounting member 22 that can facilitate mounting of the cutout 14 to the cross arm 12 of the utility pole 11. A lower contact assembly 23 is attached to the lower end 21 of the insulator 19. The lower contact assembly 23 includes a lower support member 24. Formed in the lower support member 24 are two pockets 26.

Attached to the upper end 20 of the insulator 19 is an upper contact assembly 27. The upper contact assembly 27 includes a support bar 28 that has a first segment 29 that is bent downward at about a 90° angle from a second segment 31. The first segment 29 of the support bar 28 includes two attachment hooks 32. The upper contact assembly 27 also includes an offset recoil bar 33 that has a first end 34 adjacent the insulator 19 and a second end 36. A bore 37 extends through the second end 36 of the recoil bar 33. The recoil bar 33 is attached to, and spaced apart from, the second segment 31 of the support bar 28 by a rivet 38.

Also included in the upper contact assembly 27 is a generally J-shaped spring contact 39. The spring contact 39 includes a long leg 41 and a short leg 42. Included on the end of the short leg 42 of the spring contact 39 is an indentation 43 that extends toward the long leg 41. A stud 44 extends through the bore 37 of the recoil bar 33 and is firmly attached between the legs 41–42 of the spring contact 39. The stud 44 is received in the indentation 43 formed in the short leg 42. Thus, although the spring contact 39 may flex, the legs 41–42, which are interconnected by the stud 44, are constrained to move in unison. Positioned between the second end 36 of the recoil bar 33 and a base of the indentation 43, is a spring 46 that sets a rest position for the legs 41–42 of the spring contact 39.

The cutout 14 also includes a fuse tube 51. The fuse tube 51 has an insulated body member 52. The fuse tube 51 includes an upper end 53 and a lower end 54. Attached to the lower end 54 of the fuse tube 51 is a cast component 56. A trunnion casting 57 is pivotally mounted at a toggle joint 58 to the cast component 56. Extending from the trunnion casting 57 are a pair of bosses 59. The bosses 59 are configured to be received by the pockets 26 in the lower support member 24. Thus, the lower end 54 of the fuse tube 51 can be supported by the lower contact assembly 23.

Mounted on the upper end 53 of the fuse tube 51 is a contact cap 61. The contact cap 61 is configured to fit into and be held by the indentation 43 formed in the short leg 42 of the spring contact 39. Extending from the upper end 53 of the fuse tube 51 is a pull ring 62. The upper end 53 of the fuse tube 51 is held, and latched against movement, by the upper contact assembly 27.

Figure 3:
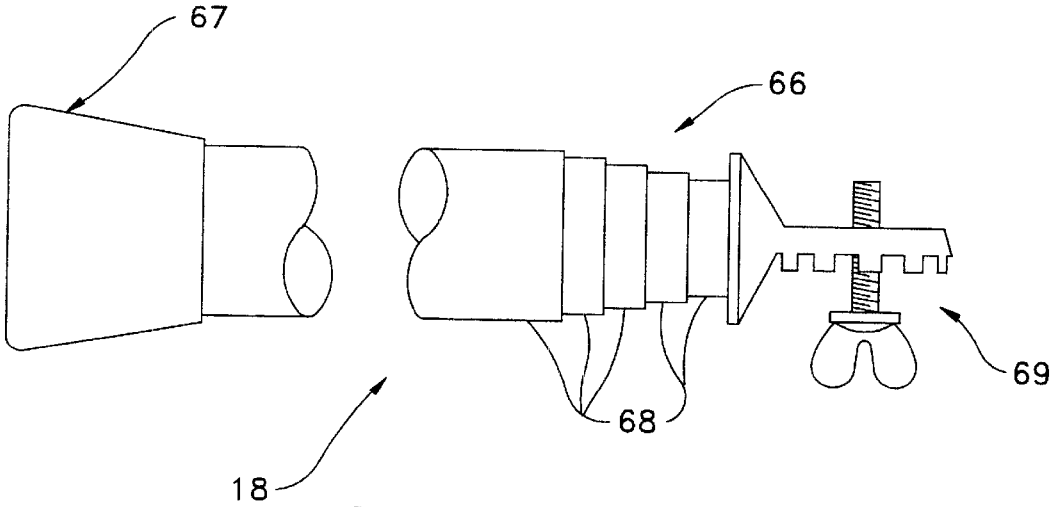
FIG. 3 (PRIOR ART)
FIG. 3 is an front view of the hot stick of FIG. 1.

Referring now to FIG. 3, there is illustrated the conventional telescoping hot stick 18 of FIG. 1. One such tool is disclosed in U.S. Pat. No. 5,593,196, entitled "Telescopic Hot Stick" and issued on Jan. 14, 1997. Since the hot stick 18 is a conventional device, a detailed description will not be provided. The telescoping hot stick 18 has a first end 66 and a second end 67. The hot stick 18 includes a number of similar length tubular sections 68 that are slidably engaged one with the other to provide a variable length for the hot stick 18. A corresponding number of locking assemblies (not shown) are provided between each adjacent section 68 for securing the adjacent sections 68 in an extended arrangement.

Figure 3A:
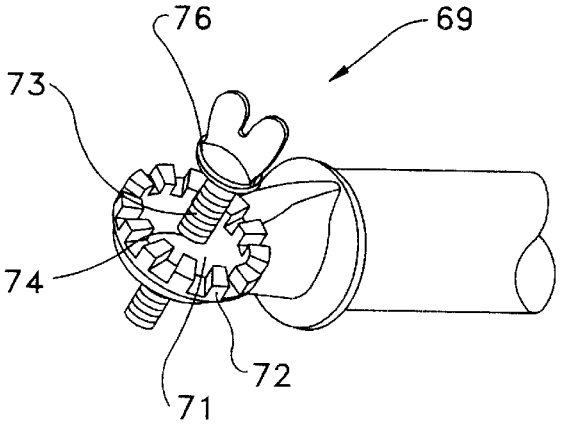
FIG. 3A (PRIOR ART)
FIG. 3A is an isometric view of the universal head attached to the hot stick of FIG. 3.

Referring in addition to FIG. 3A, positioned on the first end 66 of the hot stick 18 is a tool holder 69. The tool holder 69 is formed as what is commonly referred to as a universal head. The universal head 69 includes a circular section 71 with a plurality of teeth 72. A threaded bolt 73 is in threaded engagement with an internally threaded aperture 74. The universal head 69 also includes a restraining means such as a captive spring washer 76 that provides an axial biasing force when a tool is secured by the bolt 73 to keep the tool from working free and damaging the teeth 72. Preferably, the washer 76 is substantially concave. The axial biasing force increases as the bolt 73 is threaded father into the aperture 74 against the washer 76 and acts on the bolt 73 such that the external threads of the bolt 73 are pressing against the internal threads of the aperture 74 to frictionally restrain rotation of the bolt 73.

Figure 4:
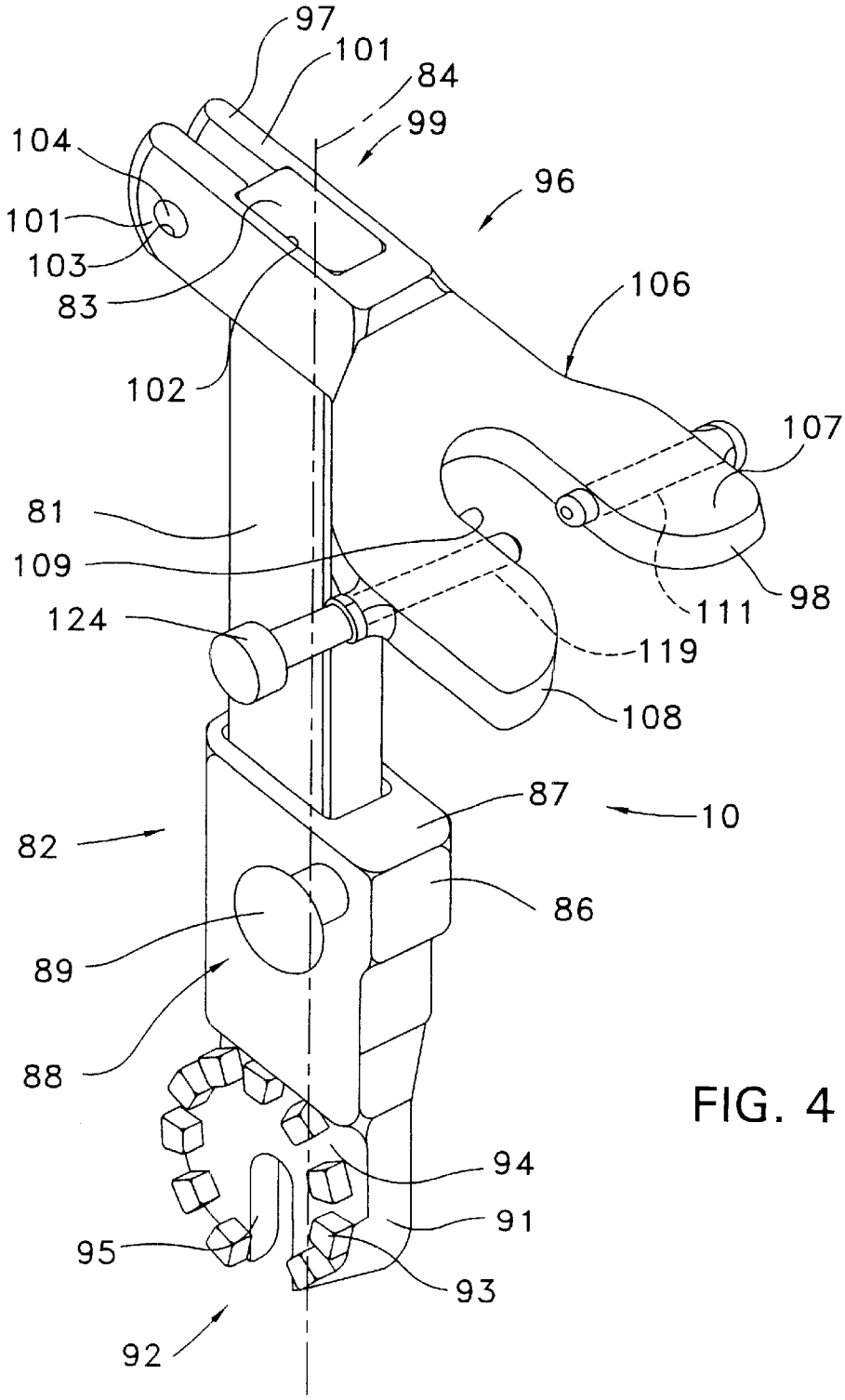
FIG. 4 is an isometric view of a cutout fuse tube installation tool according to the present invention.

Referring now to FIG. 4, there is illustrated the cutout fuse tube installation tool 10 of this invention. The installation tool 10 includes a body member 81 that has a lower end 82 and an upper end 83. The body member 81 is preferably insulated and composed of a suitable material, such as fiberglass. A longitudinal axis 84 passes through the center of the body member 81. A sleeve 86 is positioned over the lower end 82 of the body member 81. Extending through an upper end 87 of the sleeve 86 is a bolt 88. The bolt 88 includes a head 89 that is sized to receive the pull ring 62 of the fuse tube assembly 51. The bolt 88 extends from the sleeve 86 a sufficient distance to allow the pull ring 62 to be seated between the head 89 and the sleeve 86. Alternatively, the bolt 88 could be replaced by a protrusion that is machined from and extends from the sleeve 86 and has a head similar to the head 89.

A lower end 91 of the sleeve 86 is an adapter 92 that includes a plurality of teeth 93 spaced apart by a number of notches 94. The adapter 92 includes a slot 95. The adapter 92 is sized for attachment to the universal head 69 of the hot stick 18. Thus, the teeth 93 and notches 94 of the adapter 92 are oriented to compliment the teeth 72 of the universal head 69. The slot 95 is sized to receive the bolt 73 of the universal head 69 to allow the installation tool 10 to be secured to the hot stick 18.

Attached to the upper end 83 of the body member 81 is a bracket assembly 96. The bracket assembly. 96 includes a first end 97 and a second end 98. The first end 97 of the bracket assembly 96 is a clamp 99. The clamp 99 includes two arms 101 that are spaced apart by an opening 102. A bore 103 extends through the end of each of the arms 101. Inserted through the bore 101 is a fastener 104, such as a pin or a screw. The opening 102 is sized to receive the second end 83 of the body member 81. Once the second end 83 is inserted therein, the fastener 104 can be tightened to secure the bracket assembly 96 to the body member 81.

Figure 5:
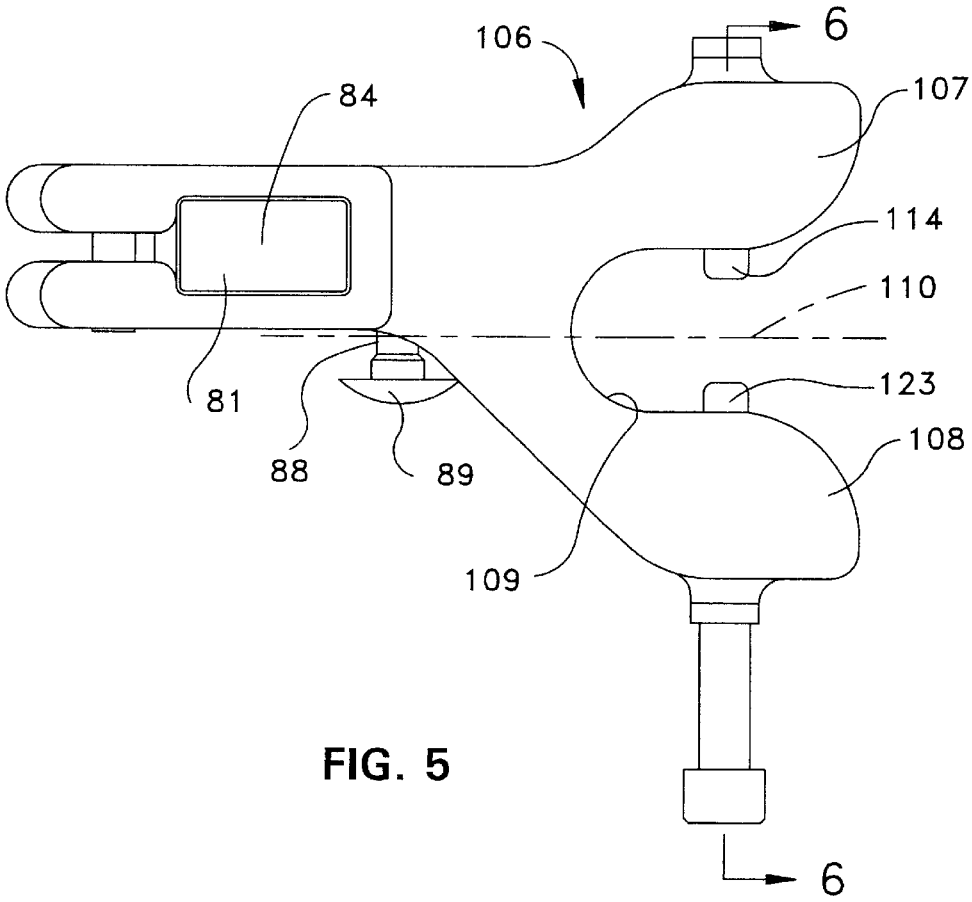
FIG. 5 is a top view of the cutout fuse tube installation tool of FIG. 4.

The second end 98 of the bracket assembly 96 is a U-shaped bracket 106. Referring in addition to FIG. 5, the bracket 106 includes a first arm 107 and a second arm 108 that are spaced apart by an opening 109. The arms 107–108 are connected to one another at one end thereof and free of connection to one another at the other end thereof. The opening 109 is sufficiently sized to receive the body member 52 of the fuse tube 51. An axis 110 passes through the opening 109 between the first arm 107 and the second arm 108. The axis 110 is off-set from the longitudinal axis 84. The distance that the axis 110 is off-set from the longitudinal axis 84 is about equal to one half of the distance between the head 89 of the bolt 88 and the sleeve 86. This orientation of the bracket 106 and the bolt 88 will allow the pull ring 62 of the fuse tube 51 to be positioned around the bolt 88 at the same time that the body member 52 of the fuse tube 51 is positioned in the opening 109, since the pull ring 62 is in the same plane as the body member 52.

Figure 6:
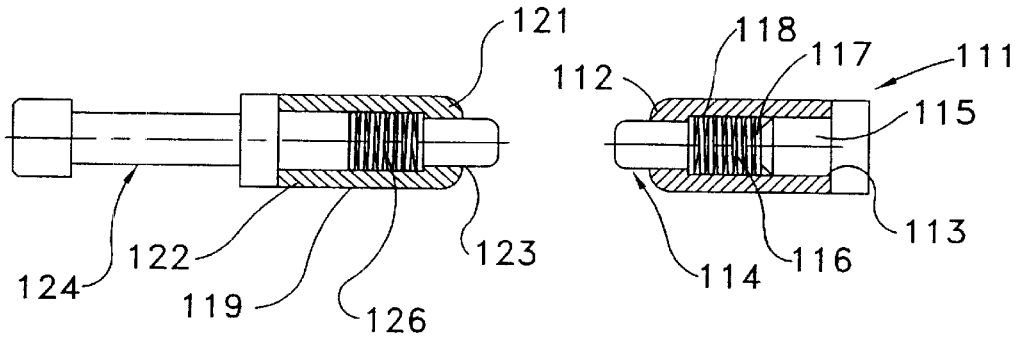
FIG. 6 is a cross-sectional view of the installation tool taken along the line 6—6 of FIG. 5.

The bracket 106 includes a movable gate device that is mounted on the arms 107–108 and can facilitate opening and closing an access to the opening through the other end. As depicted, this movable gate includes a hollow first rod 111 that is positioned within the first arm 107. Referring in addition to FIG. 6, the first rod 111 has a first end 112 and a second end 113. A pin 114 extends from the first end 112 of the first rod 111 into the opening 109. The end of the pin 114 that extends into the opening 109 is rounded. The pin 114 is sized such that it can move with respect to the first rod 111. A set screw 115 or other suitable device is positioned in the second end 113. The set screw 115 is incapable of sliding freely with respect to the second end 113. A spring 116 is positioned in the first rod 111. A first end 117 of the spring 116 is in contact with the set screw 115. A second end 118 of the spring 116 is in contact with the pin 114. The spring 116 constantly urges the pin 114 away from the set screw 115. However, when a sufficient force is exerted on the pin 114, the pin 114 can be moved away from the opening 109 against the spring 116 until it is virtually flush with the first arm 107.

Positioned in the second arm 108 is a hollow second rod 119, that is also part of the movable gate device. The second rod 119 includes a first end 121 and a second end 122. A pin 123 extends through the first end 121 into the opening 109 and is sized to move with respect to the second rod 119. As with the pin 114, the end of the pin 123 that extends into the opening 109 is rounded. An elongated member 124, such as a rod or a bolt, extends from the second end 122. The rod 124 is fitted within the second end 122 so that the rod 124 cannot slide freely with respect to the second rod 119. Positioned between the pin 123 and the rod 124 is a spring 126. The spring 126 constantly urges the pin 123 away from the rod 124. When the pin 123 is subjected to a sufficient force, the pin 123 can be moved away from the opening 109 and the first pin 114 against the spring 126 until it is virtually flush with the second arm 108.

The distance between the arms 107–108 is slightly larger than the diameter of the body member 52 of the fuse tube 51. Therefore, the body member 52 of the fuse tube 51 can slide between the arms 107–108 and act on the pins 114 and 123 to move the pins inward against their respective springs 116 and 126. The opening is sufficiently deep that the fuse tube body member 52 can be received therein and be moved out of contact with the pins 114 and 123. Thus, when the fuse tube body member 52 is positioned in the opening 109, the pins 114 and 123 extend into the opening 109, and the fuse tube body member 52 is secured within the bracket 106. In order for the fuse tube body member 52 to remain secured within the bracket 106 during installation, the spring force of the springs 116 and 126 should be sufficiently strong that movement of the fuse tube body member 52 by itself will not cause the pins 114 and 123 to move inward against the springs 116 and 126.

Figure 7:
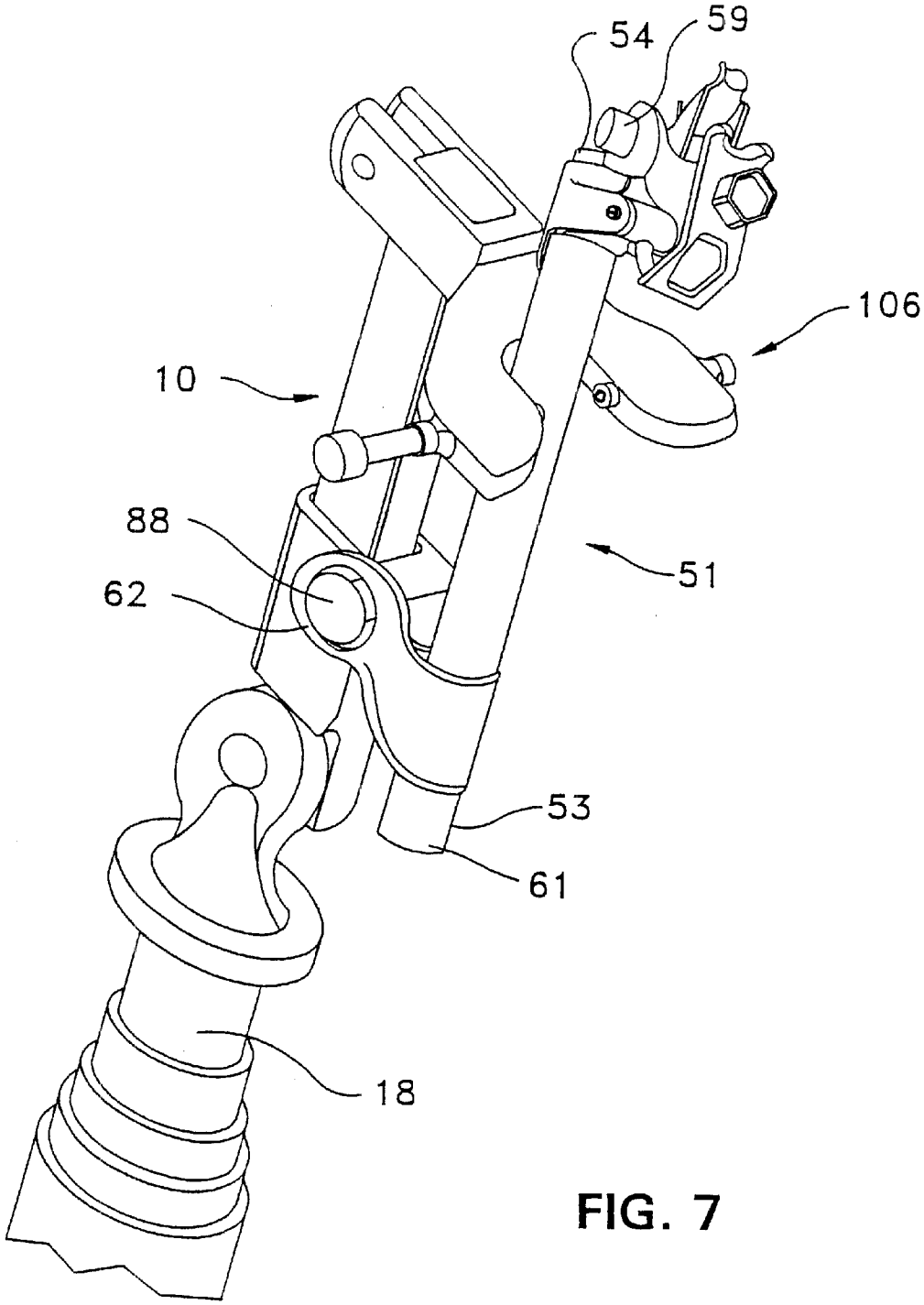
FIG. 7 is an isometric view of a cutout fuse tube secured to the installation tool of FIG. 4 prior to installation.
Figure 8:
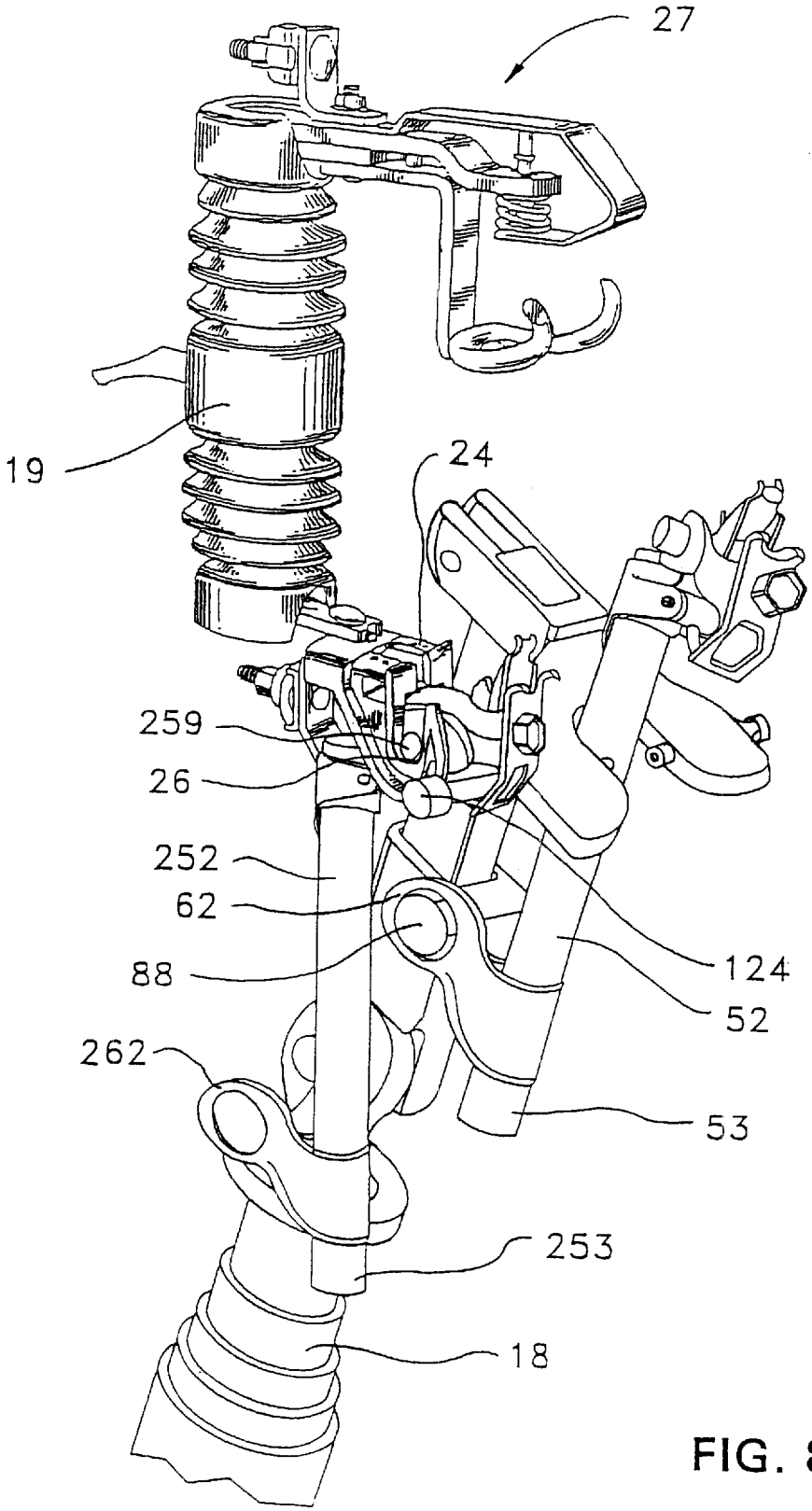
FIG. 8 is an isometric view illustrating removal of a "blown" cutout fuse tube while a new cutout fuse tube is secured to the installation tool of FIG. 4.
Figure 9:
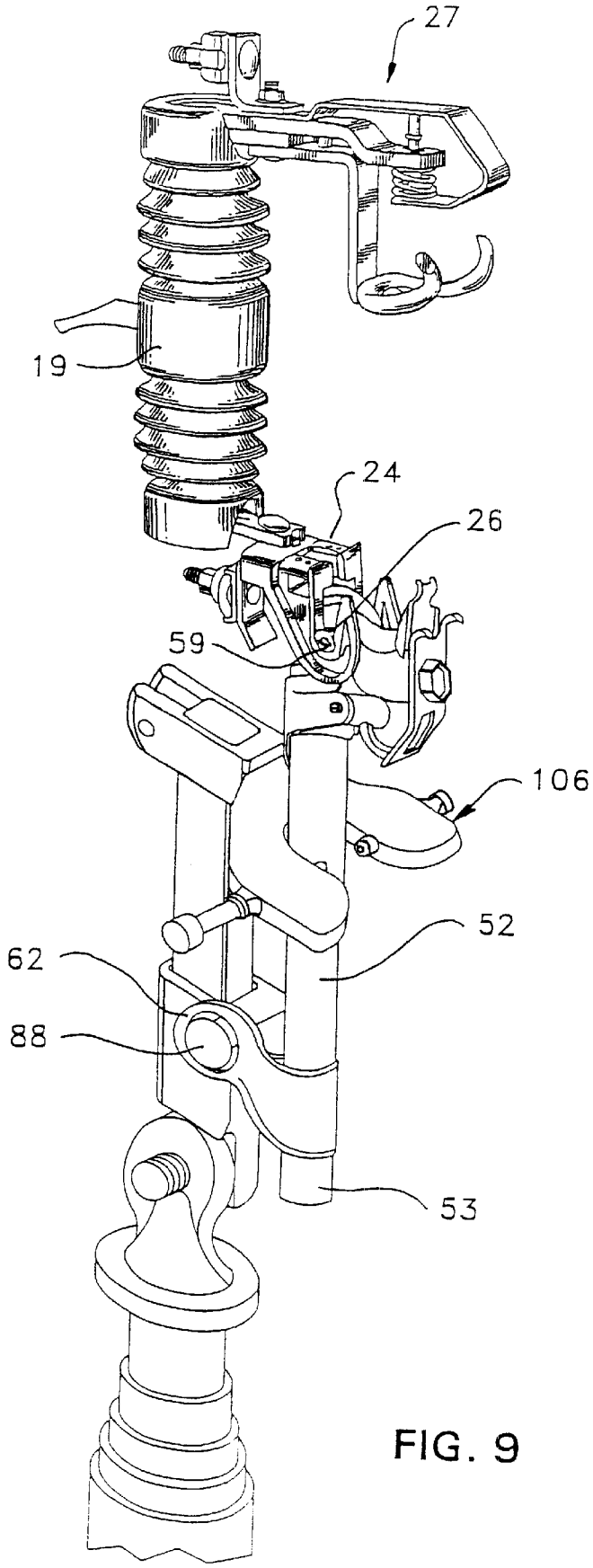
FIG. 9 is an isometric view of a partially installed cutout fuse tube, still secured to the installation tool of this invention.

Referring now to FIGS. 7–9, installation of the fuse tube 51 with the installation tool 10 of this invention will be described. Prior to installation, the installation tool 10 is secured to the hot stick 18. The bolt 73 of the universal head 69 (FIG. 3) is inserted through the slot 95 of the adapter 92 (FIG. 4). The installation tool 10 is then secured to the hot stick 18. Once the installation tool 10 is attached to the hot stick 18, the fuse tube 51 can be secured to the installation tool 10.

Referring to FIG. 7, to attach the fuse tube 51 to the installation tool 10, the pull ring 62 of the fuse tube 51 is placed over the bolt 88 that extends from the sleeve 86. The fuse tube 51 is then rotated upward so that the fuse tube body member 52 is pushed between the first and second pins 114 and 123 extending from the bracket 106. As described above, as a result of the orientation of the bracket 106 with respect to the bolt 88, the fuse tube body member 52 can be inserted into the bracket 106 while the pull ring 62 is positioned over the bolt 88. As the fuse tube body member 52 is inserted, the pins 114 and 123 are moved against the urging of the springs 116 and 126. When the pins 114 and 123 are moved away from each other, the fuse tube body member 52 can be received in the opening 109. Once the fuse tube body member 52 is seated in the opening 109, the pins 114 and 123 are returned to their biased positions by the springs 116 and 126 to secure the fuse tube body member 52 within the bracket 106.

Referring to FIG. 8, typically the fuse tube 51 will be installed to replace a fuse tube 251 that is worn out or has been "blown" as described above. The installation tool 10 of this invention can be used to remove an old fuse tube 251, as well as to install the new fuse tube 51. For continuity, those components of the old fuse tube 251 that are similar, or identical, to features of the fuse tube 51 have been labeled with feature numbers in the 200 series corresponding to the feature numbers for the fuse tube 51 that were between 10 and 64.

To remove the fuse tube 251, the hot stick 18 is extended by the utility worker 16 to a length sufficient to allow the installation tool 10 to be positioned adjacent the fuse tube 251. The elongated member 124 of the installation tool 10 is inserted through the trunnion casting 257 of the old fuse tube 251. Since the upper end 253 of the fuse tube 251 is disengaged, the fuse tube 251 will be suspended only by the bosses 259, which are supported in the pockets 26 of the lower contact assembly 24.

By appropriate maneuvering of the hot stick 18, the fuse tube 251 can be lifted to lift the bosses 259 out of the pockets 26. The old fuse tube 251 is thus disengaged from the insulator 19, and is supported on the installation tool 10 by the elongated member 124. Once the old fuse tube 251 has been disengaged, it can be removed from the installation tool 10 such as by the utility worker lowering it to the ground. Since the body member 52 of the replacement fuse tube 51 is secured by the bracket 106, the fuse tube 51 will remain attached to the installation tool 10 when the old fuse tube 251 is lowered. With the old fuse tube 251 removed, the new fuse tube 51 can be installed.

To install the new fuse tube 51, the hot stick 18 is positioned to align the bosses 59 extending from the lower end 54 of the fuse tube 51 with the pockets 26 of the lower contact assembly 24 (FIG. 9). Once the bosses 59 have engaged the pockets 26, the utility worker 16 can disengage the fuse tube 51 from the installation tool 10 to complete installation of the new fuse tube 51. To disengage the fuse tube 51, a force is exerted on the hot stick 18 by the utility worker 16 in an appropriate direction to cause the fuse tube body member 52 to act against the pins 114 and 123. The force exerted by the fuse tube body member 52 on the pins 114 and 123 causes the pins 114 and 123 to move away from each other against the urging of the springs 116 and 126. Once the fuse tube body member 52 is disengaged from the bracket 106, the pull ring 62 can be removed from the bolt 88. The fuse tube 51 is therefore supported only by the bosses 59 which are seated in the pockets 26. The rod 124 is then inserted through the pull ring 62, or other location behind the fuse tube 51, and the hot stick 18 is maneuvered to rotate the fuse tube 51 toward the upper contact assembly 27. Once the first end 53 of the fuse tube 51 is adjacent the upper contact assembly 27, the contact cap 61 can be snapped into place in the spring contact 39 to complete installation of the fuse tube 51.

It should be appreciated that the foregoing description is for the purposes of illustration only, and alternative embodiments of this invention are possible without departing from the scope of the claims. For instance, while the installation tool 10 of this invention has been described for use with a conventional hot stick 18, this description is not intended to be limiting. The installation tool 10 could instead be used with any other suitable device. Indeed, the sleeve 86 could be removed from the body member 81 of the tool 10 and replaced with a sleeve including an adapter that is suitable for use with an alternative device. Alternatively, the installation tool 10 could be formed without the sleeve. In this instance, the adapter 92 could be formed from the first end 82 of the body member 81 and the bolt 88 could be inserted directly into the body member 81. Additionally, the bracket assembly 99 could be a portion of the second end 82 of the body member 81, rather than being attached to the second end. Further, a number of modifications could be made to the bracket 106. For instance, the arms 107–108 could be contained in different planes. In addition, the gate device could include a single pin that extends from only one arm 107 of 108. Further, the pins 114 and 123, which have been illustrated herein having rounded ends that extend into the opening 109 could instead have flat or even cone-shaped ends.

Thus, although particular preferred embodiments of the present invention have been disclosed in detail for illustrative purposes, it will be recognized that variations or modifications lie within the scope of the present invention and do not depart from the spirit of the invention, as set forth in the foregoing description and drawings, and in the following claims.

What is claimed is:

1. A cutout fuse tube installation tool, comprising:

a body member having a longitudinal axis and including a first end and a second end;

a protrusion extending from said first end of said body member and having a head end spaced apart from said body member;

said second end of said body member including a bracket having a first arm spaced apart from a second arm to define an opening therebetween, said first and second arms being connected to one another at one end thereof and free of connection to one another at another end thereof;

said bracket having a bracket axis that passes through said opening;

said bracket, said protrusion and said bracket axis being configured such that a plane containing said bracket axis passes between said head end of said protrusion and said body member; and a movable gate device mounted on at least one of said first and second arms to facilitate opening and closing an access to said opening through said another end.

2. The cutout fuse tube installation tool of claim 1, wherein said movable gate device includes at least one pin that extends into said opening from at least one of said first arm and said second arm, wherein said at least one pin is movable relative to said opening between an extended position and a retracted position; and a spring is compressed between said at least one pin and a spring abutment, wherein said spring is configured to constantly urge said at least one pin toward said extended position.

3. The cutout fuse tube installation tool of claim 1, wherein an elongated member extends from one of said first arm and said second arm of said bracket away from said opening.

4. The cutout fuse tube installation tool of claim 2, wherein said spring is a first spring and said at least one pin includes a first pin extending into said opening from said first arm;

wherein a second pin extends into said opening from said second arm and is movable between a retracted position and an extended position; and a second spring is compressed between said second pin and a spring abutment, wherein said second spring is configured to constantly urge said second pin toward said extended position.

5. The cutout fuse tube installation tool of claim 4, wherein said opening has a width that is about equal to a diameter of a fuse tube body member; and a distance between said first pin and said second pin when said first pin and said second pin are in said extended positions is less than said diameter.

6. The cutout fuse tube installation tool of claim 5, wherein said head end is spaced apart from said body member a sufficient distance such that a pull ring included on said fuse tube body member can be positioned between said head end and said body member; and said protrusion and said bracket are oriented such that said pull ring can be positioned over said protrusion when said fuse tube body member is received in said opening.

7. The cutout fuse tube installation tool of claim 2, wherein said spring abutment is an elongated member that extends out of said at least one of said first arm and said second arm away from said opening.

8. The cutout fuse tube installation tool of claim 1, wherein said body member is insulated.

9. The cutout fuse tube installation tool of claim 1, wherein said first end of said body member includes an adapter that is sized and configured for attachment to a hot stick.

* * * * *